US010767648B2

(12) United States Patent
Zouani et al.

(10) Patent No.: US 10,767,648 B2
(45) Date of Patent: Sep. 8, 2020

(54) VANE OIL PUMP WITH A RELIEF PASSAGE COVERED BY AN INNER ROTOR TO PREVENT FLOW TO A DISCHARGE PORT AND A ROTOR PASSAGE PROVIDING FLOW TO SAID PORT

(71) Applicant: Ford Global Technologies, LLC, Dearborn, MI (US)

(72) Inventors: Abdelkrim Zouani, Canton, MI (US); Vidya Marri, Northville, MI (US); Michael Stanley, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 307 days.

(21) Appl. No.: 15/888,390

(22) Filed: Feb. 5, 2018

(65) Prior Publication Data

US 2019/0242378 A1 Aug. 8, 2019

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/344*** | (2006.01) |
| ***F04C 14/24*** | (2006.01) |
| ***F04C 13/00*** | (2006.01) |
| ***F04C 15/06*** | (2006.01) |
| ***F04C 14/22*** | (2006.01) |

(52) U.S. Cl.

CPC ..... *F04C 2/344* (2013.01); *F04C 13/001* (2013.01); *F04C 14/223* (2013.01); *F04C 14/24* (2013.01); *F04C 15/06* (2013.01); *F04C 2210/206* (2013.01); *F04C 2240/20* (2013.01); *F04C 2250/20* (2013.01)

(58) Field of Classification Search

CPC ..... F04C 2/344; F04C 13/001; F04C 14/223; F04C 14/24; F04C 15/06; F04C 2210/206; F04C 2/3442; F04C 14/22; F04C 14/226; F04C 15/062; F04C 2240/20; F04C 2250/10; F04C 2250/101; F04C 2250/20

USPC ..... 418/24, 26–27, 30–31, 104, 259–260

See application file for complete search history.

(56) References Cited

U.S. PATENT DOCUMENTS

| | | | | |
|---|---|---|---|---|
| 1,792,026 | A * | 2/1931 | Nichols | F01C 1/3446 418/186 |
| 1,913,758 | A * | 6/1933 | Hapkins | F04C 2/34 418/266 |
| 3,964,844 | A * | 6/1976 | Whitmore | F04C 14/223 418/133 |
| 5,064,362 | A * | 11/1991 | Hansen | F04C 15/06 418/186 |
| 7,070,399 | B2 | 7/2006 | Konishi et al. | |
| 9,512,837 | B2 | 12/2016 | Liu et al. | |
| 9,759,103 | B2 | 9/2017 | Armenio et al. | |
| 2007/0212243 | A1* | 9/2007 | Yamamuro | F04C 2/3442 418/30 |

(Continued)

*Primary Examiner* — Theresa Trieu

(74) *Attorney, Agent, or Firm* — Brooks Kushman P.C.; Geoffrey Brumbaugh

(57) ABSTRACT

A vane pump has a housing defining a closed conduit fluidly coupling a discharge port and a planar surface, and an inner rotor eccentrically supported within a cam. The rotor has an outer perimeter defined by wall sections separated by axial slots. The rotor defines another closed conduit extending from one of the wall sections to a rotor end face that is configured to overlap with the closed conduit.

18 Claims, 5 Drawing Sheets

(56) References Cited

U.S. PATENT DOCUMENTS

| | | | | |
|---|---|---|---|---|
| 2017/0089233 | A1* | 3/2017 | Moetakef | F04C 2/3442<br>418/229 |
| 2017/0122311 | A1 | 5/2017 | Moetakef | |

* cited by examiner

VANE OIL PUMP WITH A RELIEF PASSAGE COVERED BY AN INNER ROTOR TO PREVENT FLOW TO A DISCHARGE PORT AND A ROTOR PASSAGE PROVIDING FLOW TO SAID PORT

TECHNICAL FIELD

Various embodiments relate to a vane oil pump for a powertrain component such as an internal combustion engine or a transmission in a vehicle.

BACKGROUND

An oil pump is used to circulate oil or lubricant through powertrain components such as an engine or a transmission in a vehicle. The oil pump is often provided as a vane pump. Vane pumps have a positive displacement characteristic and tight clearances between various components of the pump that result in the formation of pressure ripples or fluctuations of the fluid within the pump and the attached oil galleries during operation of the pump. The pressure ripples of the fluid generated by the pump may act as a source of excitation to powertrain components, for example, when the pump is mounted to the powertrain components. For example, the pump may be mounted to an engine block, a transmission housing, an oil pan or sump housing, a transmission bell housing, and the like, where the pressure ripples may cause tonal noise or whine from the engine or the transmission. This oil pump-induced powertrain whine or tonal noise is a common noise, vibration, and harshness (NVH) issue.

SUMMARY

In an embodiment, a vane fluid pump for a vehicle component is provided. A cam defines a continuous inner wall surrounding a cavity. An inner rotor is supported within the cam and has a cylindrical outer wall extending between first and second end walls. The cylindrical outer wall defines (n) slots spaced about the outer wall to provide (n) outer wall sections, with each outer wall section bounded by adjacent slots. The inner rotor defines (n) fluid passages with each fluid passage having an entrance intersecting a respective one of the (n) outer wall sections and an outlet intersecting the first end wall. A series of vanes is provided with each vane positioned within a respective slot of the inner rotor and extending outwardly to contact the continuous inner wall of the cam. A pump housing supports the cam, the inner rotor, and the series of vanes. The pump housing defines a planar surface between an inlet port and a discharge port, and the first end wall of the inner rotor is supported by the planar surface. The planar surface defines a relief passage having an entrance intersecting the planar surface and an outlet intersecting the discharge port. The inner rotor, the cam, and the vanes cooperate to form a plurality of variable volume pumping chambers to pump fluid from a fluid inlet of the pump to a fluid outlet of the pump. Each of the (n) fluid passages is configured to overlap the relief passage to provide a fluid connection between the associated pumping chamber and the discharge port, and the relief passage is otherwise covered by the inner rotor to prevent fluid flow through the relief passage and to the discharge port.

In another embodiment, a vane pump inner rotor is provided with a body having a series of side wall sections and a series of slots extending between first and second end faces. The side wall sections and the slots alternate about a perimeter of the body. The body defines a series of fluid passages with each side wall section defining an entrance to an associated fluid passage, and each fluid passage having an outlet intersecting the first end face.

In yet another embodiment, a vane pump is provided with a housing defining a closed conduit fluidly coupling a discharge port and a planar surface, and an inner rotor eccentrically supported within a cam. The rotor has an outer perimeter defined by wall sections separated by axial slots. The rotor defines another closed conduit extending from one of the wall sections to a rotor end face that is configured to overlap with the closed conduit.

DETAILED DESCRIPTION

Figure 1:
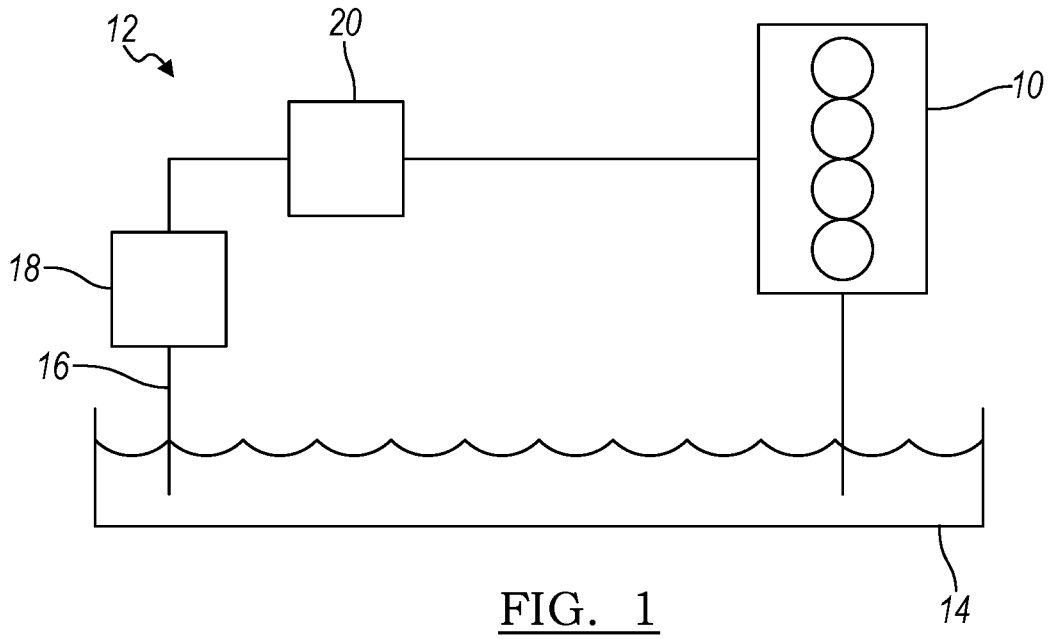
FIG. 1 illustrates a schematic of a lubrication system for an internal combustion engine in a vehicle according to an embodiment.

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

A vehicle component 10, such as an internal combustion engine or transmission in a vehicle, includes a lubrication system 12. The vehicle component 10 is described herein as an engine, although use of the system 12 with other vehicle components is contemplated. The lubrication system 12 provides a lubricant, commonly referred to as oil, to the engine during operation. The lubricant or oil may include petroleum-based and non-petroleum-synthesized chemical compounds, and may include various additives. The lubrication system 12 circulates oil and delivers the oil under pressure to the engine 10 to lubricate components in motion relative to one another, such as rotating bearings, moving pistons and engine camshaft. The lubrication system 12 may additionally provide cooling of the engine. The lubrication system 12 may also provide the oil to the engine for use as a hydraulic fluid to actuate various tappets, valves, and the like.

The lubrication system 12 has a sump 14 for the lubricant. The sump 14 may be a wet sump as shown, or may be a dry sump. The sump 14 acts as a reservoir for the oil. In one example, the sump 14 is provided as an oil pan connected to the engine and positioned below the crankshaft.

The lubrication system 12 has an intake 16 providing oil to an inlet of a pump 18. The intake 16 may include a strainer or filter and is in fluid contact with oil in the sump 14.

The pump 18 receives oil from the intake 16 and pressurizes and drives the oil such that it circulates through the system 12. The pump 18 is described in greater detail below with reference to FIGS. 2-6 according to an embodiment. In one example, the pump 18 is driven by a rotating component of the engine 10, such as a belt or mechanical gear train driven by the crankshaft, a balance shaft, the camshaft, or the like. In other examples, the pump 18 may be driven by another device, such as an electric motor.

The oil travels from the pump 18, through an oil filter 20, and to the vehicle component or engine 10. The oil travels through various passages within the engine 10 and then leaves or drains out of the engine 10 and into the sump 14.

The lubrication system 12 may also include an oil cooler or heat exchanger to reduce the temperature of the oil or lubricant in the system 12 via heat transfer to a cooling medium such as environmental air. The lubrication system 12 may also include additional components that are not shown including regulators, valves, pressure relief valves, bypasses, pressure and temperature sensors, additional heat exchangers, and the like.

The pump 18 has a positive displacement along with tight clearances between various components that result in the formation of pressure ripples within the pump and the attached oil galleries. The pressure ripples may be formed as the oil is delivered from a low pressure side to a high pressure side via a series of discrete oil pockets or pumping chambers, and result in pressure ripples at the pump outlet. The pressure ripples may act as an underlining excitation energy within the associated lubrication system. For example, the pressure ripples of the pump when mounted on a vehicle component such as an engine block or a transmission housing may act as an excitation source to the various components, such as an oil pan, transmission bell housing, etc. The excitation energy may additionally lead to noise, vibration, and harshness (NVH) issues, such as whine noise under light vehicle acceleration or during vehicle deceleration.

FIGS. 2-7 illustrate a pump 50 and various components thereof. The pump 50 may be used in the lubrication system 12 as pump 18.

Figure 2:
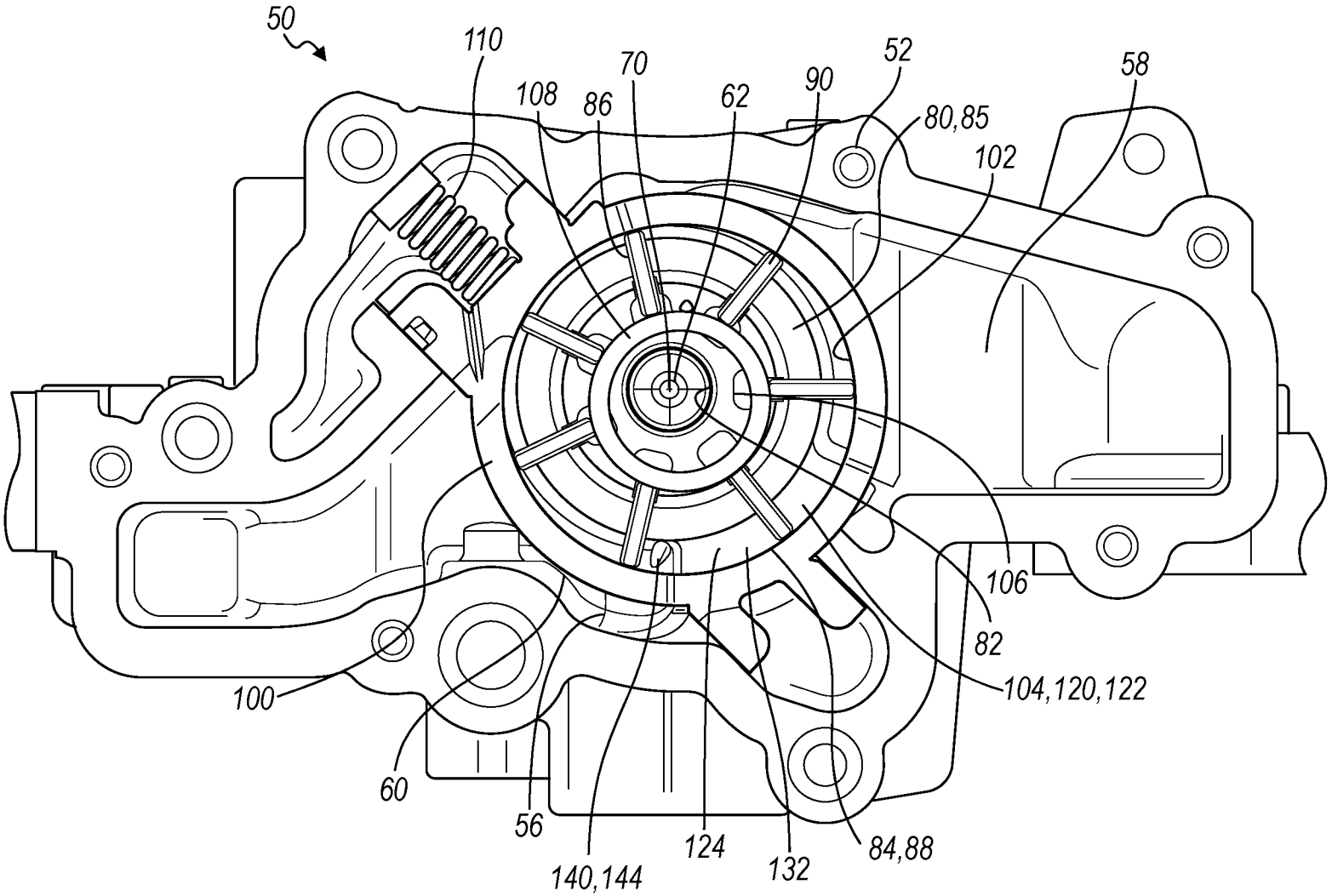
FIG. 2 illustrates a partial perspective view of a vane pump according to an embodiment.

Referring to FIG. 2, the pump 50 is a vane pump, and is illustrated as being a sliding vane pump. In other examples according to the present disclosure the vane pump 50 may be other types of vane pumps including pendulum vane pumps, swinging vane pumps, etc. The pump may additionally be provided as a variable displacement pump according to various examples.

The pump 50 has a housing 52 and a cover (not shown). The housing 52 and the cover cooperate to form an internal chamber 56. The cover connects to the housing 52 to enclose the chamber 56. The cover may attach to the housing 52 using one or more fasteners, such as bolts, or the like. A seal, such as an O-ring or a gasket, may be provided to seal the chamber 56.

The pump 50 has a fluid inlet 58 and a fluid outlet 60. The fluid inlet 58 has an inlet port that is adapted to connect to a conduit such as intake 16 in fluid communication with a supply, such as an oil sump 14. The fluid inlet 58 is fluidly connected with the chamber 56 such that fluid within the inlet 58 flows into the chamber 56. The cover and/or the housing 52 may define portions of the inlet 58 region and inlet port. The inlet 58 may be shaped to control various fluid flow characteristics.

The pump 50 has a fluid outlet 60 or fluid discharge region with an outlet port that is adapted to connect to a conduit in fluid communication with an oil filter, a vehicle component such as an engine, etc. The fluid outlet 60 is fluidly connected with the chamber 56 such that fluid within the chamber 56 flows into the outlet 60. The cover and/or the housing 52 may define portions of the outlet 60 region. The outlet 60 may be shaped to control various fluid flow characteristics. The inlet 58 and the outlet 60 are spaced apart from one another in the chamber 56, and in one example, may be generally opposed to one another.

The pump 50 has a pump shaft or driveshaft 62. The pump shaft 62 is driven to rotate components of the pump 50 and drive the fluid. In one example, the pump shaft 62 is driven by a mechanical coupling with an engine, such that the pump shaft rotates as an engine component such as a crankshaft rotates, and a gear ratio may be provided to provide a pump speed within a predetermined range. In one example, an end of the pump shaft 62 is splined or otherwise formed to mechanically connect with a rotating vehicle component to drive the pump 50.

The other end of the shaft 62 is supported for rotation within the cover and housing 52 of the pump 50. The cover and housing 52 may define supports for the end of the shaft 62 to rotate therein. The support may include a bushing, a bearing connection, or the like. The shaft 62 rotates about a longitudinal axis 70 of the shaft.

The shaft 62 extends through the housing 52, and the housing 52 defines an opening for the shaft to pass through. The opening may include a sleeve or a seal to retain fluid within the pump and prevent or reduce leakage from the chamber 56. The opening may also include additional bushings or bearing assemblies supporting the shaft for rotation therein.

An inner rotor 80 or inner gear is connected to the pump shaft 62 for rotation therewith. The inner rotor 80 has an inner surface or wall 82 and an outer surface or wall 84. The inner wall 82 is formed to couple to the pump shaft for rotation therewith about the axis 70. In one example, the inner wall 82 is splined to mate with a corresponding splined section of the pump shaft, and in another example, is press fit onto the shaft 62.

The outer wall 84 provides an outer circumference or perimeter of the inner rotor 80. In one example, the outer wall 84 is cylindrical or generally cylindrical. In other examples, the outer wall 84 is provided by another shape. The outer wall 84 extends between opposed end faces 85 or end walls 85 of the inner rotor 80.

The inner rotor 80 has a series of slots 86 and a series of outer wall sections 88, or side wall sections. In the example shown, the inner rotor 80 has seven slots and seven outer wall sections. The rotor 80 may have two or more vanes and two or more corresponding outer wall sections in other examples. The slots 86 are spaced apart about the outer wall 84, and in one example, are equally spaced or spaced at equivalent angles about the inner rotor. In other examples, the slots 86 may be variably spaced or spaced at varying angles about the inner rotor. The slots 86 define or provide the outer wall sections, as they divide the outer wall 84. Each outer wall section 88 is bounded by adjacent slots 86. The slots 86 and outer wall sections 88 alternate about a perimeter of the inner rotor. The outer walls sections 88 may lie about a perimeter of a common cylinder or common polygon such that each outer wall section has a surface formed by a segment or sector of the cylinder or polygon. For an inner rotor with equally spaced slots 86, each outer wall segment may have the same shape and size. For an inner rotor with unequally or variably spaced slots 86, the outer wall segments may have varying shapes and sizes.

A series of vanes 90 is provided, with each vane positioned within a respective slot 86. Each slot 86 is sized to receive a respective vane. The vanes 90 are configured to slide within the slots 86. The vanes 90 and slots 86 may extend radially outward from the inner rotor 80 and axis 70, or may extend non-radially outwardly from the inner rotor 80.

Each outer wall section 88 extends between adjacent vanes 90. The inner rotor 80 rotates as the pump shaft 62 rotates. In the example shown, the inner rotor 80 rotates in a rotational direction, e.g. a clockwise direction as shown in FIG. 2, about axis 70.

The pump 50 has a cam 100 that has a continuous inner wall 102. The cam 100 is supported within the internal chamber 56 of the housing 52. The inner wall 102 may be a cylindrical shape as shown. The inner wall 102 defines a cavity 104. The inner rotor 80 and the vanes 90 are arranged and supported within the cavity 104 of the cam 100.

The inner rotor 80 may be eccentrically supported within the cam 100 such that the axis 70 of the inner rotor is offset from an axis or the center of the cylindrical inner wall 102 and the cam 100.

In one example, as shown, the pump 50 is a variable displacement pump and may include a control mechanism 110 such as a spring or passively or actively controlled pressure compensator that changes the position of the cam ring 100 in the housing, thereby changing the eccentricity between the cam ring 100 and the inner rotor 80 to change the size of the pumping chambers and vary the displacement per revolution of the pump. Alternatively, the cam ring 100 may have various protrusions or locating features that cooperate with the housing 52 to position and fix a location of the cam ring 100 in the pump 50.

The vanes 90 extend outwardly from the inner rotor, and a distal end of each vane 90 is adjacent to and in contact with the inner wall 102 of the cam 100 during pump operation. The inner rotor 80, the cam 100, and the vanes 90 cooperate to form a plurality of variable volume pumping chambers 120 to pump fluid from a fluid inlet 58 of the pump to a fluid outlet 60 of the pump. The vanes act to divide the chamber 56 into pumping chambers 120, with each vane positioned between adjacent pumping chambers 120. As the inner rotor 80 rotates, the spacing between the outer wall 84 of the inner rotor and the cam inner wall 102 changes at various angular positions around the cam 100. The chamber 122 formed by the inner rotor, vanes, and cam near the inlet port 58 increases in volume, which draws fluid into the chamber from the inlet port. The chamber 124 near the outlet port 60 is decreasing in volume, which forces fluid from the chamber into the discharge port and out of the pump.

The vanes 90 may slide outwardly during pump operation based on centrifugal forces to contact the inner wall of the cam and seal the variable volume chambers. In other examples, a mechanism such as a spring, or a hydraulic fluid, may bias the vanes outwardly to contact the cam inner wall.

The inner rotor 80 may include undervane passages 106 that act as back pressure chambers for pressure relief as the vane retracts. The inner rotor 80 may also include a vane ring 108 supported on one of the end faces 85 of the inner rotor 80 that prevents retraction of the vanes when the pump 50 is stopped and centrifugal forces on the vanes are absent. The proximal end of the vanes 90 abuts the vane ring 108.

Figure 3:
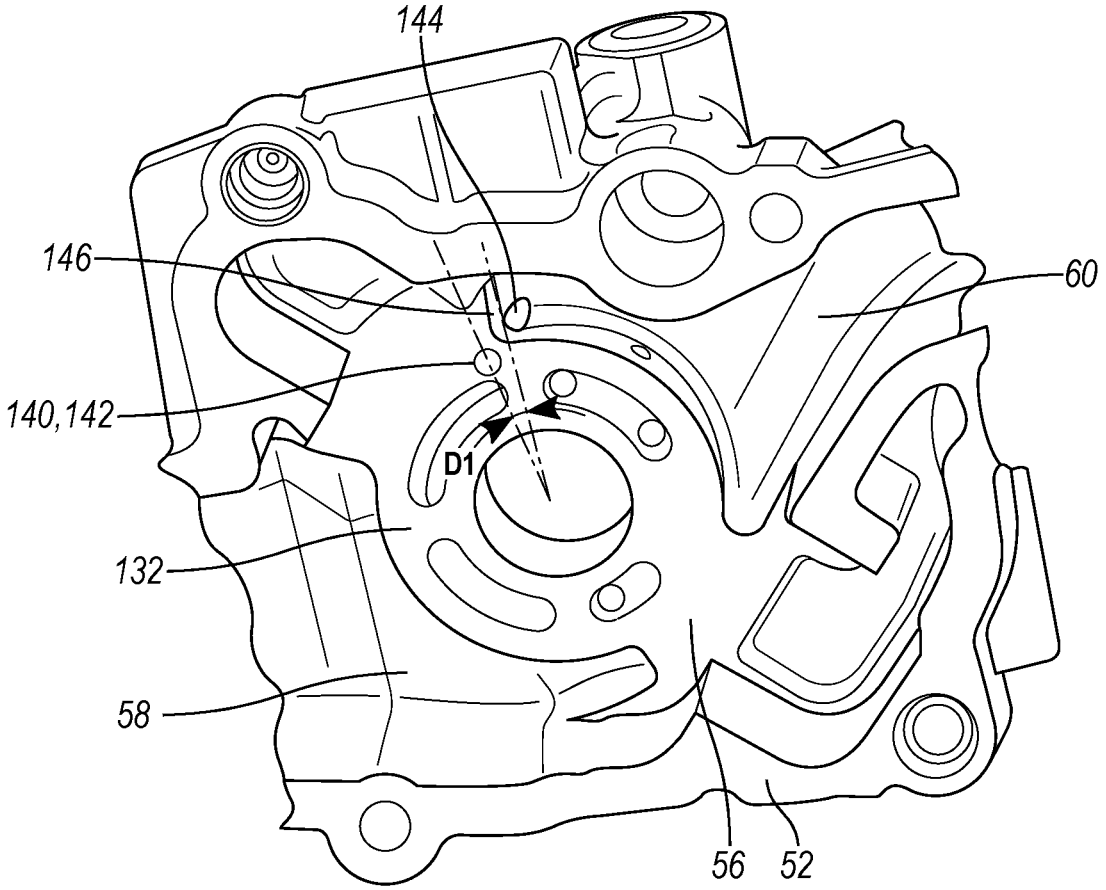
FIG. 3 illustrates a perspective view of a housing for use with the vane pump of FIG. 2.
Figure 4:
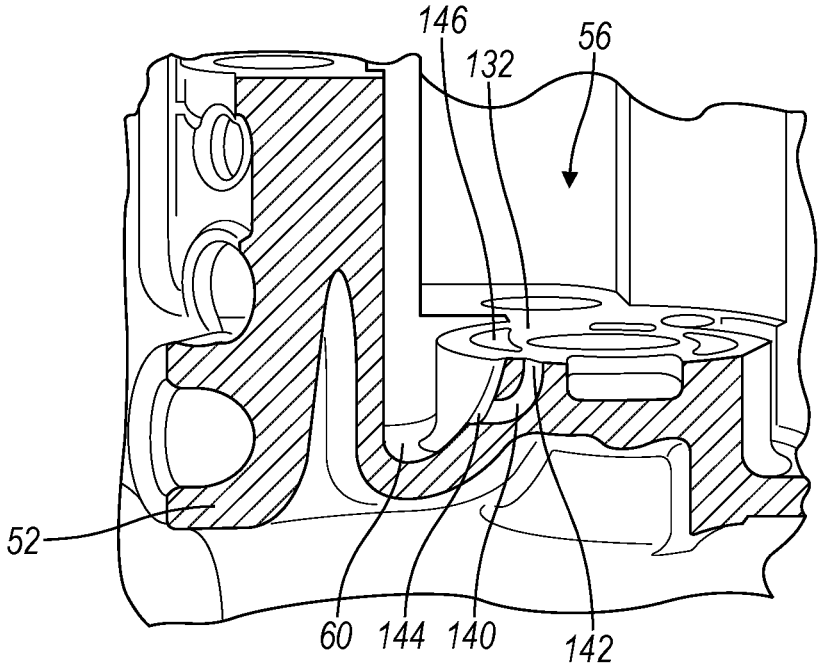
FIG. 4 illustrates a partial sectional view of the housing of FIG. 3.

FIGS. 3-4 illustrate the housing 52 of the pump 50. The housing 52 has an inlet port and inlet chamber area 58 and a discharge port and outlet chamber area 60. The housing 52 defines a surface 132. The surface 132 is generally planar and the inner rotor 80 is supported by the surface 132 on an end face 85 of the rotor 80. The planar surface 132 extends between the inlet port 58 and the discharge port 60.

The housing 52 defines a fluid passage 140 or relief passage. The relief passage 140 may be provided as a closed conduit within the body of the housing 52. The relief passage 140 has a first end intersecting the planar surface 132 to provide an entrance to the passage. The relief passage 140 has a second end 144 intersecting the discharge port 60 or outlet chamber of the pump to provide an outlet for the passage. The entrance 142 to the passage is upstream of the outlet 144 from the passage. As shown, the entrance 142 to the passage is provided on an intermediate location on the surface 132, and is spaced apart from and nonintersecting with the discharge port 60. The entrance 142 to the passage may be provided at a first angular distance D1 from a leading edge or upstream edge 146 of the discharge port 60 and area. The outlet 144 from the passage is spaced apart from and nonintersecting with the planar surface 132.

The passage 140 provides for fluid communication between an upstream chamber 120 and the fluid outlet chamber 60 of the pump 50 as described in further detail below. The passage 140 may have a curved shape as shown, and may have other linear or non-linear shapes. The passage 140 is illustrated as having a circular cross-sectional shape; however, other cross-sectional shapes are also contemplated.

Figure 5:
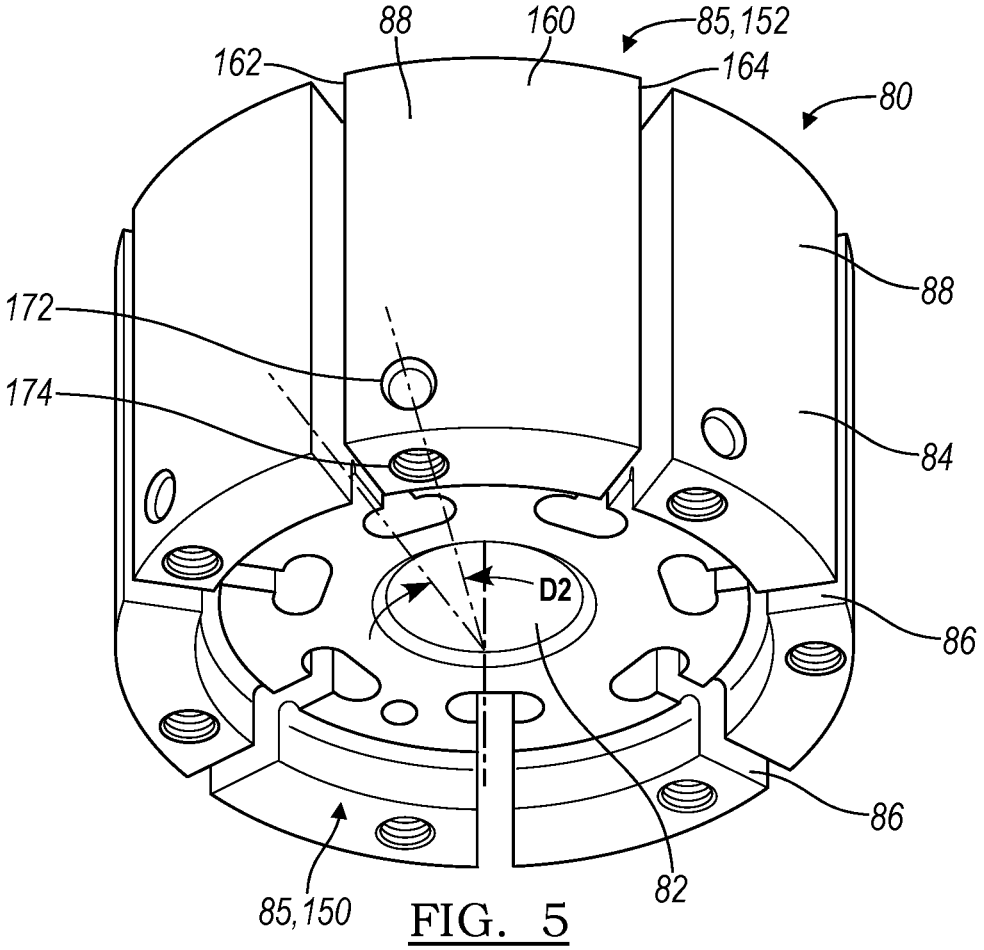
FIG. 5 illustrates a perspective view of an inner rotor for use with the vane pump of FIG. 2.
Figure 6:
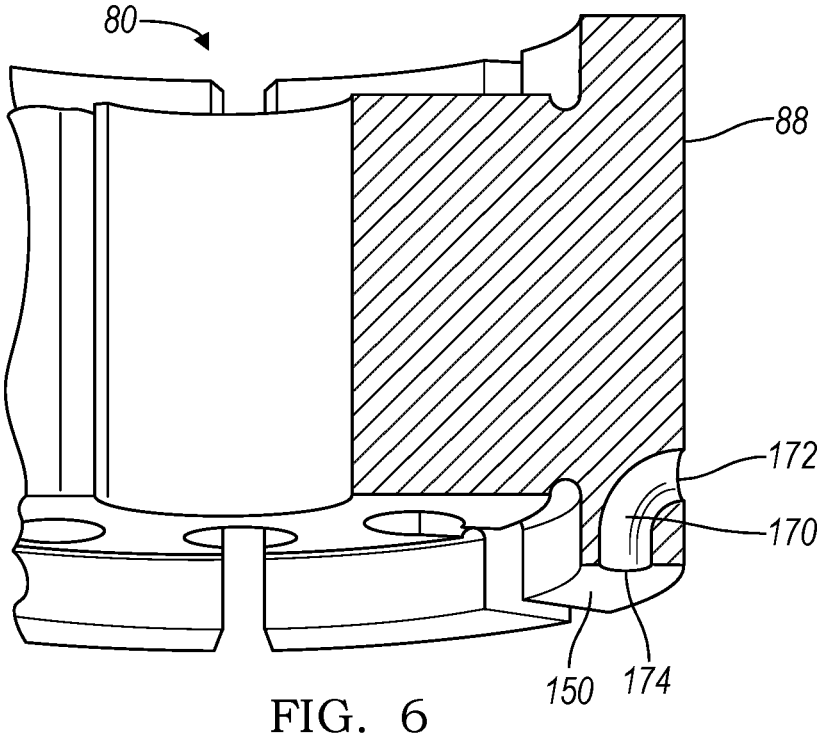
FIG. 6 illustrates a partial sectional view of the inner rotor of FIG. 5.

FIGS. 5-6 illustrate an inner rotor 80 for use with the pump 50. The inner rotor 80 has a body defining first and second opposed end walls 85, 150, 152 or end faces, and a cylindrical outer wall 84 extending between the end walls 85. The body has a series of side wall sections 88 and a series of slots 86 extending between first and second end faces 85, with the side wall sections 88 and the slots 86 alternating about a perimeter of the body. The cylindrical outer wall 84 defines (n) slots spaced about the outer wall to provide (n) outer wall sections 88, with each outer wall section 88 bounded by adjacent slots 86. The outer wall sections 88 define an outer perimeter of the inner rotor 80 and are separated by the slots 86. The slots 86 are shown as being equally spaced, but may also be provided with variable or unequal spacing in other examples.

The first end face or end wall 150 is supported by the housing 52, including the planar surface 132. The first end wall 150 is further configured to cover the entrance 142 to the relief passage 140 in the housing such that the inner rotor 80 extends radially outboard of the entrance 142 to the relief passage.

The inner rotor 80 is configured to rotate within the pump housing 52, and therefore each outer wall section 88 has an associated upstream edge adjacent to an upstream slot and vane, and a downstream edge adjacent to a downstream slot and vane. For example, wall section 160 has an upstream edge 162 and a downstream edge 164.

The inner rotor 80 defines a series of passages 170, with each passage 170 is associated with a respective one of the outer wall sections 88, and the associated pumping chamber 120. Each fluid passage 170 may be provided as a closed conduit within the body of the inner rotor 80. In one example, the rotor 80 has (n) wall sections 88 and (n) associated passages 170. In other examples, one or more of the wall sections 88 may be without an associated passage 170.

Each fluid passage 170 has a first end 172 intersecting a respective one of the (n) outer wall sections 88 to form an entrance to the fluid passage 140. Each fluid passage 170 also has a second end 174 intersecting the first end face 150 or first end wall to provide an outlet for the passage. The entrance and outlet 172, 174 for each passage may be one another as shown. In other examples, the entrance 172 may be radially offset from the outlet 174 for the fluid passage.

The entrance 172 to the passage is provided on an associated wall section 88, and is spaced apart from and nonintersecting with the first and second end walls 150, 152 of the inner rotor. The entrance 172 to the passage may be provided at a second angular distance D2 from the upstream edge 162 of the associated wall section or from a centerline of the associated upstream vane or slot.

The outlet 174 from the passage is spaced apart from and nonintersecting with the cylindrical outer wall 84 and wall sections 88 and the second end wall 152. The outlet 174 from the passage may also be provided at a second angular distance D2 from the upstream edge 162 of the associated wall section or from a centerline of the associated upstream vane or slot. The second angular distance D2 may be greater than the first angular distance D1.

Each passage 170 may have a curved shape as shown, and may have other linear or non-linear shapes. Each passage 170 is illustrated as having a circular cross-sectional shape; however, other cross-sectional shapes are also contemplated.

Each of the fluid passages 170 in the inner rotor 80 is configured to overlap the relief passage 140 in the housing 52 to selectively fluidly connect the associated upstream pumping chamber 120 to the discharge port 60. The outlet 174 of each fluid passage 170 in the inner rotor 80 overlaps the entrance 142 to the relief passage 140 in the housing 52 when the inner rotor 80 is at specified angular positions with respect to the housing 52 during pump operation. Unless one of the fluid passages 170 and the relief passage 140 are overlapped, the relief passage 140 is covered by the first end wall 150 of the inner rotor such that fluid flow through the relief passage 140 is prevented. Therefore, the oil can only flow from a pumping chamber 120 to the outlet port 60 at specific angular positions of the rotor 80.

Therefore, each of the (n) fluid passages 170 is configured to overlap the relief passage 140 to provide a fluid connection between the associated pumping chamber 120 and the discharge port 60, and the relief passage 140 is otherwise covered by the inner rotor 80 to prevent fluid flow through the relief passage 140 and to the discharge port 60.

In other embodiments, the passages 170 of the inner rotor 80 may be alternatively or additionally provided between the outer wall sections 88 and the second end face 152 of the inner rotor, and the relief passage 140 may be alternatively or additionally provided in a planar surface of the cover for the pump. Additionally, the passages 170 for the inner rotor 80 are shown as being identically sized and spaced on the inner rotor. In other examples, the passages 170 may vary in size, shape, and or positioning, e.g. second angular distance D2, to further control the fluid flow and pressure ripples and control and reduce pump whine.

The passages 170 in the rotor and the relief passage 140 in the housing provide for reduced pump whine noise with a low impact on oil pump performance, and without additional components or significant manufacturing time or costs.

Figure 7:
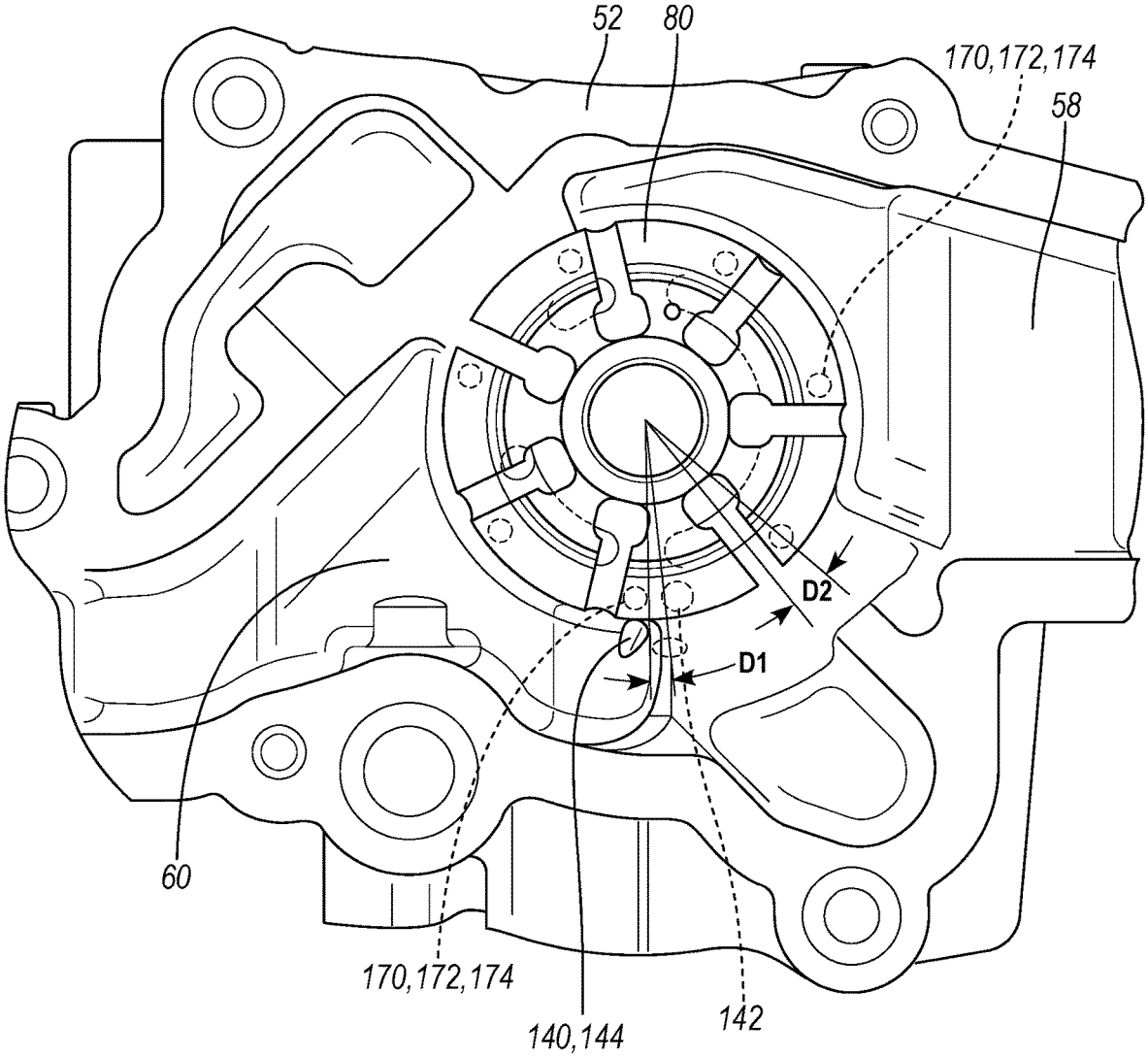
FIG. 7 illustrates a partial top view of the pump of FIG. 2 with the rotor in a first position.

FIG. 7 illustrates the inner rotor 80 and the cam 100 with the inner rotor 80 in a first rotational position in the pump. The vanes and cam are removed from the view for clarity. With the rotor 80 in a first position as shown, the outlet 174 to a fluid passage 170 in the rotor may be offset from and away from an entrance 142 to the relief passage 140 in the housing such that the surface of the rotor end wall 150 blocks or prevents fluid in pumping chambers 120 from entering the relief passage 140. As the rotor 80 rotates, the outlet 174 from the fluid passage 170 in the rotor overlaps with the entrance 142 to the relief passage 140 in the housing to provide a fluid connection or flow from the pumping chamber 120, into the relief passage 140 and to the outlet chamber 60. This acts to disrupt the buildup of large pressure spikes during operation as a small portion of fluid from an upstream chamber is flowing to the outlet chamber 60. As can be seen from the Figure, the fluid passage 170 may be in fluid communication with the relief passage 140 for a predetermined number of degrees based on the sizes of the fluid passage and relief passage.

The first angular position D1 for the entrance of the relief passage 140 in the housing, and the second angular position D2 for the entrance and outlet of the fluid passages 170 in the rotor may be selected such that the entrance 172 to the rotor fluid passage 170 is located at a position where the pressure in the associated pumping chamber 120 is at a peak value, and such that the outlet 174 of the rotor fluid passage 170 is aligned with the entrance 142 to the relief passage 144 just prior to the pressure in the associated pumping chamber 120 reaching the peak value and while the leading or upstream vane is preventing fluid flow from the associated chamber 120 to the outlet ports 60.

Referring to FIG. 7 and according to an example, the pump 50 may be provided with (n) as seven such that the inner rotor 80 has seven vanes 90, seven wall sections 88, seven pumping chambers 120, and seven fluid passages 170. The first angular distance D1 is in a range of four to eight degrees of inner rotor 80 rotation from the leading edge 146 of the outlet port 60 on the planar surface 132. The second angular distance D2 is in a range of ten to fifteen degrees of inner rotor 80 rotation from a leading vane 90 of the inner rotor for the entrance 142 and outlet 144 of the associated rotor fluid passage 170. A diameter or effective diameter of each of the rotor fluid passages 170 and relief passage 140 is on the order of two to four millimeters, and the cross-sectional area of the relief passage and each of the (n) fluid passages may lie within a range of three to sixteen millimeters-squared (mm^2). In further examples, the first and second angular distances D1, D2 and the passage diameters may vary, for example, with other pump operating conditions or based on another number of vanes in the pump.

As the relief passage 140 is blocked except at (n) discrete angular positions of the rotor 80 associated with the (n) fluid passages 170 in the rotor, the fluid flow from the upstream pumping chamber 120 to the discharge port 60 only occurs at the pump harmonics (ie n, 2*n*, 3*n*, 4*n*, 5*n*, etc.). The spatiotemporal nature of the rotor passages 170 and relief passage 140 provides for improved NVH performance for the pump 50 at the pump harmonics while reducing the impact on the performance of the pump.

Initial modelling results for NVH for the pump according to FIG. 7 compared to a conventional pump without fluid passages in the inner rotor and without a relief passage as disclosed provided a noise reduction for various pump harmonics as follows: a sound pressure level reduction of over four decibels for the third harmonic, a sound pressure level reduction of over five decibels for the fourth harmonic, a sound pressure level reduction of over four decibels for the fifth harmonic, and a sound pressure level reduction of over three decibels for the sixth harmonic.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure.

Additionally, the features of various implementing embodiments may be combined to form further embodiments of the disclosure.

What is claimed is:

1. A vane fluid pump for a vehicle component comprising:

a drive shaft rotatable in a first direction;

a cam defining a continuous inner wall surrounding a cavity;

an inner rotor supported within the cam and drivably connected to the drive shaft for rotation in the first direction, the inner rotor having a cylindrical outer wall extending between first and second end walls, the cylindrical outer wall defining (n) slots spaced about the cylindrical outer wall to provide (n) outer wall sections, each outer wall section bounded by adjacent slots, the inner rotor defining (n) fluid passages, each fluid passage having an entrance intersecting a respective one of the (n) outer wall sections and an outlet intersecting the first end wall;

a series of vanes, each vane positioned within a respective slot of the inner rotor and extending outwardly to contact the continuous inner wall of the cam; and a pump housing supporting the drive shaft, the cam, the inner rotor, and the series of vanes, the pump housing defining a planar surface between an inlet port and a discharge port, the first end wall of the inner rotor supported by the planar surface, the housing defining a relief passage having an entrance intersecting the planar surface and an outlet intersecting the discharge port;

wherein the inner rotor, the cam, and the vanes cooperate to form a plurality of variable volume pumping chambers to pump fluid from a fluid inlet of the pump to a fluid outlet of the pump in response to the drive shaft rotating in the first direction;

wherein each of the (n) fluid passages is configured to overlap the relief passage to provide a fluid connection between the associated pumping chamber and the discharge port as the drive shaft rotates in the first direction; and wherein the relief passage is otherwise covered by the first end wall of the inner rotor to prevent fluid flow through the relief passage and to the discharge port as the drive shaft rotates in the first direction.

2. The vane fluid pump of claim 1 wherein the entrance of the relief passage is nonintersecting with the discharge port, and wherein the outlet of the relief passage is nonintersecting with the planar surface.

3. The vane pump of claim 1 wherein the entrance of each of the (n) fluid passages is nonintersecting with the first and second end walls, and wherein the outlet of each of the (n) fluid passages is nonintersecting with the cylindrical outer wall.

4. The vane pump of claim 1 wherein the outlet to each of the (n) fluid passages is radially aligned with the associated entrance to the fluid passage.

5. The vane pump of claim 4 wherein the entrance of the relief passage is at a first angular distance upstream of the discharge port on the planar surface.

6. The vane pump of claim 5 wherein each of the outer wall sections has upstream and downstream edges formed by the slots on either side of the each of the outer wall sections, the upstream and downstream edges defined by a rotational direction of the inner rotor; and wherein the entrance to each of the (n) fluid passages is spaced a second angular distance from the upstream edge of the each of the outer wall sections of the inner rotor.

7. The vane pump of claim 6 wherein the first angular distance is in a range of four to eight degrees of inner rotor rotation; and wherein the second angular distance is in a range of ten to fifteen degrees of inner rotor rotation.

8. The vane pump of claim 7 wherein a cross-sectional area of the relief passage and each of the (n) fluid passages lies within a range of three to sixteen millimeters-squared.

9. The vane pump of claim 7 wherein (n) is seven.

10. The pump of claim 1 wherein each of the (n) fluid passages is provided as a closed conduit; and wherein the relief passage is provided as a closed conduit.

11. The pump of claim 1 further comprising a drive shaft coupled for rotation with the inner rotor; and wherein the continuous inner wall of the cam is cylindrical; and wherein the inner rotor is eccentrically supported within the cam.

12. The pump of claim 1 wherein each vane is slidably received by the respective slot of the inner rotor.

13. A vane pump inner rotor comprising:

a body having a series of side wall sections and a series of slots extending between a first end face and a second end face opposite to the first end face, the side wall sections and the slots alternating about a perimeter of the body, the body defining a series of fluid passages, each side wall section defining an entrance to an associated fluid passage, each fluid passage having an outlet intersecting the first end face;

wherein the entrance of each fluid passage is spaced apart from and nonintersecting with the first end face and the second end face of the inner rotor;

wherein the outlet of each fluid passage is spaced apart and nonintersecting with the second end face and side wall sections; and wherein each fluid passage is spaced apart from and nonintersecting with the second end face.

14. The vane pump inner rotor of claim 13 wherein the entrance and the outlet of each fluid passage are radially aligned with one another.

15. The vane pump inner rotor of claim 13 wherein each fluid passage is provided as a closed conduit.

16. A vane pump comprising:

a housing defining a fluid inlet a fluid outlet with a discharge port, and a closed conduit fluidly coupling the discharge port and a planar surface;

a drive shaft supported by the housing for rotation in a first direction;

a cam supported within the housing; and an inner rotor drivingly connected to the drive shaft for rotation in the first direction, the inner rotor eccentrically supported within the cam, the inner rotor having an outer perimeter defined by wall sections separated by axial slots to define pumping cambers therebetween, and defining another closed conduit extending from one of the wall sections to a rotor end face and configured to overlap with the closed conduit to provide a fluid connection between the closed conduit and associated pumping chamber of the inner rotor and the discharge port as the drive shaft rotates in the first direction to pump fluid from the fluid inlet to the fluid outlet;

wherein the closed conduit is otherwise covered by the rotor end face of the inner rotor to prevent fluid flow through the closed conduit and to the discharge port as the drive shaft rotates in the first direction;

wherein the closed conduit intersects the planar surface at a first angular distance upstream of a leading edge of the discharge port;

wherein the another closed conduit of the inner rotor intersects the one of the wall sections and the rotor end face at a second angular distance from an associated upstream axial slot; and wherein the second angular distance is greater than the first angular distance.

17. The vane pump of claim 16 wherein the closed conduit of the housing is otherwise covered by the inner rotor to prevent fluid flow therethrough.

18. The vane pump of claim 16 wherein the planar surface is immediately upstream of the discharge port.

* * * * *